US010165803B2

(12) United States Patent
Hoeven

(10) Patent No.: US 10,165,803 B2
(45) Date of Patent: Jan. 1, 2019

(54) TEXTILE LINGERIE ARTICLE WITH IMPROVED HOLD

(71) Applicant: HANES OPERATIONS EUROPE SAS, Rueil Malmaison (FR)

(72) Inventor: Manon Turlan-Van Der Hoeven, Marmagne (FR)

(73) Assignee: Hanes Operations Europe SAS, Rueil-Malmaison ( * ) Notice: Subject to any disclaimer, the term of this patent is extended or adjusted under 35 U.S.C. 154(b) by 117 days.

(21) Appl. No.: 14/906,238

(22) PCT Filed: Jul. 21, 2014

(86) PCT No.: PCT/FR2014/051868
§ 371 (c)(1),
(2) Date: Jan. 19, 2016

(87) PCT Pub. No.: WO2015/008006
PCT Pub. Date: Jan. 22, 2015

(65) Prior Publication Data

US 2016/0157529 A1 Jun. 9, 2016

(30) Foreign Application Priority Data

Jul. 19, 2013 (FR) ..... 13 57128

(51) Int. Cl.
*A41C 3/06* (2006.01)
*A41B 17/00* (2006.01)
*A41B 11/12* (2006.01)

(52) U.S. Cl.
CPC ..... *A41C 3/065* (2013.01); *A41B 11/12* (2013.01); *A41B 11/128* (2013.01); *A41B 17/00* (2013.01); *A41B 2400/82* (2013.01)

(58) Field of Classification Search
CPC ..... A41C 3/065; A41B 11/12; A41B 17/00; A41B 11/128
(Continued)

(56) References Cited

U.S. PATENT DOCUMENTS 2,988,087 A * 6/1961 Krieger ..... A41C 3/06 450/81
3,253,599 A * 5/1966 Bjorn-Larsen ..... A41B 11/128 2/409

(Continued)

FOREIGN PATENT DOCUMENTS

CN 200980338 Y 11/2007
CN 201064118 Y 5/2008

(Continued)

OTHER PUBLICATIONS

Japan Patent Office, Notice of Reason for Rejection, Japanese Patent Application No. 2016-526686, dated Mar. 14, 2017, 10 pages.

(Continued)

*Primary Examiner* — Katherine M Moran
(74) *Attorney, Agent, or Firm* — Fish & Richardson P.C.

(57) ABSTRACT

The disclosure concerns a lingerie item comprising at least one holding element (3) capable of holding said lingerie item when it is being worn, said holding element (3) consisting of a textile material provided, on the inner surface (31) of same intended to come into contact with the skin, with a discontinuous coating (4) of elastomeric material capable of preventing said lingerie item from slipping. According to the disclosure, said discontinuous coating (4) of elastomeric material comprises a pattern of protrusions (41) of elastomeric material in the form of grains of rice having a distribution of omnidirectional orientation in the reference system of the inner surface (31) of the holding element (3), said protrusions (41) comprising dimensions and a distribution such that the density of protrusions per (Continued)

surface unit of the holding element (3) is at least 10 protrusions per square centimetre, and preferably between 10 and 40.

24 Claims, 1 Drawing Sheet

(58) Field of Classification Search
USPC ..... 450/1, 81, 95, 155
See application file for complete search history.

(56) References Cited

U.S. PATENT DOCUMENTS

| | | | | |
|---|---|---|---|---|
| 3,662,760 | A * | 5/1972 | Erteszek | A41F 11/18 2/240 |
| 3,800,331 | A | 4/1974 | Taddeo | |
| 5,497,513 | A | 3/1996 | Arabeyre et al. | |
| 6,059,834 | A | 5/2000 | Springs | |
| 6,332,825 | B1 | 12/2001 | Henricksen | |
| 6,446,268 | B1 | 9/2002 | Lazarian | |
| 6,673,421 | B1 | 1/2004 | Andrews et al. | |
| 6,871,516 | B2 | 3/2005 | Peeler et al. | |
| 7,025,738 | B2 * | 4/2006 | Hall | A61F 5/01 128/882 |
| 8,990,965 | B2 | 3/2015 | Waldman et al. | |
| 9,254,009 | B2 | 2/2016 | Abbott et al. | |
| 2003/0220048 | A1 | 11/2003 | Toro et al. | |
| 2003/0232556 | A1 | 12/2003 | Toro et al. | |
| 2005/0266770 | A1 * | 12/2005 | Henricksen | A41C 3/0007 450/1 |
| 2006/0260024 | A1 | 11/2006 | Lee | |
| 2010/0100024 | A1 | 4/2010 | Reid, Jr. | |
| 2011/0112459 | A1 | 5/2011 | Mathieu et al. | |
| 2013/0165018 | A1 * | 6/2013 | Barker | A61F 5/03 450/95 |
| 2014/0173808 | A1 | 6/2014 | Collins et al. | |
| 2016/0037832 | A1 * | 2/2016 | Kogon | A41C 3/06 450/86 |

FOREIGN PATENT DOCUMENTS

| | | | |
|---|---|---|---|
| CN | 102946830 | A | 2/2013 |
| EP | 2335504 | A2 | 6/2011 |
| EP | 2335504 | B1 | 4/2013 |
| JP | S563056 | A | 1/1981 |
| JP | S5983906 | U | 6/1984 |
| JP | H0353503 | U | 5/1991 |
| JP | 3085783 | U | 5/2002 |
| JP | 2002129404 | A | 5/2002 |
| JP | 2001316910 | | 11/2011 |
| KR | 20080003447 | U | 8/2008 |
| KR | 1020130070569 | A | 6/2013 |
| WO | WO2006011168 | A1 | 2/2006 |
| WO | WO2010063581 | A1 | 6/2010 |
| WO | WO2015015438 | A1 | 2/2015 |

OTHER PUBLICATIONS

Korean Intellectual Property Office, Office Action, Korean Application No. 10-2016-7004049, dated Feb. 16, 2017, 11 pages.

PCT International Search Report and Written Opinion of the International Searching Authority, PCT/FR2014/051868, dated Nov. 5, 2014, 10 pages.

The State Intellectual Property Office of the People's Republic of China, Chinese Application No. 2014800410894, Notification of the First Office Action, dated Jul. 5, 2016, 20 pages.

Australian Government IP Australia, Australian Application No. 2014291910, Patent Examination Report No. 1, 2 pages.

Mexican Office Action in Mexican Application No. MX/a/2016/000658, dated May 19, 2017, 12 pages. (with English translation).

Korean Office Action in Korean Application No. 10-2016-7004049, dated Sep. 12, 2017, 8 pages. (with English translation).

Japan Patent Office, Notice of Reason for Rejection, Japanese Patent Application No. 2016-526686, dated Nov. 30, 2017, 9 pages (with English Translation).

* cited by examiner

TEXTILE LINGERIE ARTICLE WITH IMPROVED HOLD

TECHNICAL FIELD

The disclosure relates to a textile lingerie item comprising at least one holding element capable of holding this lingerie item when it is worn, which holding element is constituted by a textile material provided on its inner surface intended to come in contact with the skin with a discontinuous coating of elastomeric material capable of preventing the slipping of this lingerie item.

BACKGROUND

The term textile lingerie item denotes any item of male or female underwear designed with holding elements capable of being supplemented with an elastomeric material of the silicone type, for example, in order to obtain an anti-sliding function for the lingerie item and in particular for brassieres, especially of the strapless type, and hosiery items of the tightfitting type, stockings, knee-length stockings, socks or even high socks.

Therefore, it is known, for example, to provide at the top of stockings or also on the back parts of a strapless brassiere called "strapless" a coating of silicone, especially of the tacky type, that is, with a consistency between adhesive and sticky ("tacky" according to English terminology") intended to hold the lingerie item in place without slipping due to movements of the body. In the case of the top of stockings this coating is preferably made over the entire inner surface of the stocking top in the form of a continuous surface deposit, which can have a length of several centimeters and a certain thickness for an optimal anti-slippage effect. As concerns the "strapless" brassieres, they are classically supplemented with continuous bands of silicone extending along the edge of the back parts of the brassiere with, for example two bands of silicone arranged on the upper edge of the back part and one band of silicone on the lower edge.

Now, the usage of silicone under these conditions proved to be directly associated with the appearance of more or less severe cutaneous reactions in the users. In fact, since silicone is an impermeable elastomer, the silicone bands gripping the skin function by inducing a harmful occlusion phenomenon on the skin, preventing it from regulating its quantity of water and blocking the exchanges with the outer environment. This phenomenon of occlusion favors an excessive perspiration followed by a maceration of the skin whose surface is therefore rendered fragile. In addition, the movements of the body induce a scissors effect of the silicone bands on the skin due to the fact of the difference of elasticity between the skin and the silicone but also on account of the rubbing of the silicone on the skin. This rubbing, added to the occlusion phenomenon, rapidly becomes a source of cutaneous irritations that can be expressed by the appearance of reddened areas, micro-cuts and even blisters (peeling of the epidermis and of the dermis).

The attempt has already been made to reduce to the maximum the surface occupied by the silicone bands on the back part of the brassiere in order to limit the undesirable effects mentioned above but, however, to the detriment of the anti-slipping properties of the brassiere.

The patent document US 2008/0236417 teaches an edge of a siliconized hosiery item for holding the hosiery item in place without slipping and which comprises a discontinuous coating of silicone on the inner surface of the edge intended to come in contact with the skin. This discontinuous coating is formed by a repeated pattern of points and of segments of silicone arranged in the form of types of stars deposited on the surface of the edge of the hosiery item and using an impression by screen printing technique. The points and segments of silicone are placed in such a manner as to cover a substantial part of the surface of the edge of the hosiery item, thus creating a significant contact surface of the silicone with the skin lying underneath it, while the spaces left between them allow a certain ability of the skin to breathe to be retained. However, the adherence capacity obtained by the presence of this silicone pattern is not optimal, which prevents hoping to use it to supplement a part of the back of a strapless brassiere, an item for which the expectations of the users in terms of hold and of comfort are very high.

SUMMARY

Therefore, a goal of the disclosure is to improve the previously cited disadvantages and to propose a textile lingerie item provided with siliconized holding elements that achieve mechanical properties of adherence on the skin that are significantly improved, while nevertheless preventing the phenomena of occlusion of the skin and considerably reducing the compression and the rubbing on the skin, creating even more comfort and more confidence when wearing it.

To this end the textile lingerie item that otherwise is in conformity with the generic definition given in the above preamble is essentially characterized in that this discontinuous coating of elastomeric material comprises a pattern of protrusions of elastomeric material shaped like grains of rice having a distribution of omnidirectional orientation in the reference system of the inner surface of the holding element, which protrusions comprise dimensions and a distribution such that the density of the protrusions per surface unit of the holding element is at least 10 protrusions per square centimeter and is preferably comprised between 10 and 40 protrusions per square centimeter.

Therefore, the disclosure describes the combination of a particular form of the protrusions of elastomeric material placed on the inner surface of the holding element with a specific distribution of orientation of these protrusions within the pattern in the reference system of the inner surface of the holding element and with a relatively elevated density of protrusions per surface unit. This combination of characteristics proper to the protrusions, which are their shape, orientation and their density, ensures the advantages of improvement, in particular of the adherence and the comfort during wearing without, however, having to deal with the negative aspects of using silicone, which were mentioned above.

The density of the protrusions can advantageously be comprised between 25 and 36 protrusions per square centimeter.

These protrusions can advantageously have a length of at least 1.5 mm, preferably between 2 and 3 mm.

These protrusions can advantageously have a width of at least 0.5 mm, preferably between 1 and 1.5 mm.

These protrusions can advantageously have a thickness of at least 0.3 mm, preferably between 0.5 and 1 mm.

The distance between two adjacent protrusions is preferably between 0.5 and 2 mm.

The distribution of relative orientation between adjacent protrusions is advantageously such that each protrusion has an orientation noticeably different from those of the respective adjacent protrusions.

The elastomeric material is advantageously silicone or polyurethane.

The lingerie item is advantageously a brassiere, in particular without straps, comprising two cups connected by their respective outer side to parts of the back of the brassiere constituting this element for holding the brassiere.

The lingerie item can also advantageously be a hosiery item terminated by an edge rib or a cord constituting this holding element of this hosiery article.

BRIEF DESCRIPTION OF THE DRAWINGS

Other particularities and advantages of the invention will be apparent from a reading of the description given below of a particular embodiment of the invention given by way of example but non-limiting, with reference made to the attached drawings in which.

DETAILED DESCRIPTION

Figure 1:
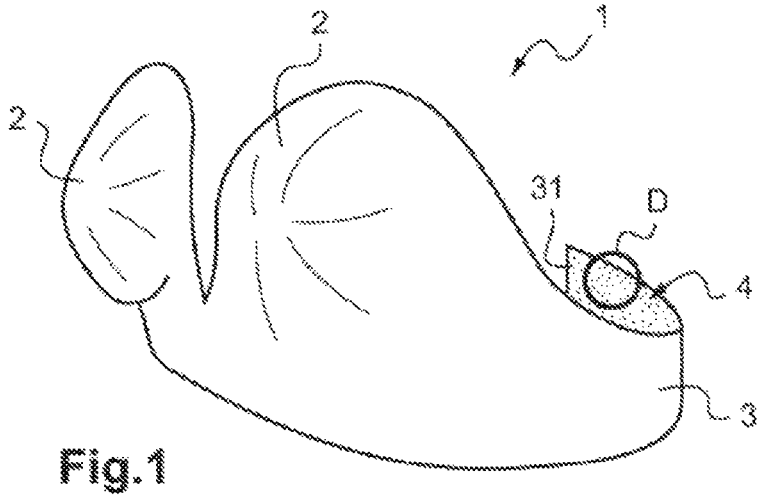
FIG. 1 is a perspective schematic view of a brassiere in conformity with the invention.

A preferred embodiment of the disclosure relates to a strapless brassiere of a known type. This strapless brassiere 1 of the disclosure thus comprises two cups 2 that are concave on the side of their inside face (substantially hemispheric), which are connected to one another on the outer side at lateral parts 3 forming the back of the brassiere when they are attached to one another by an attachment device that is not shown. These lateral parts 3 of the back therefore constitute the holding element of the brassiere and are capable of making up for the absence of the hold customarily obtained by the straps and are in particular designed to prevent the brassiere from slipping after having been worn for a certain time. In order to do this, the inner surface 31 of the parts of the back 3 of the brassiere 1 intended to make contact with the skin is constituted by an elastic textile material lined with a pattern based on silicone or polyurethane forming a discontinuous lining 4 preferably extending in both directions of the inner surface 31 in such a manner as to cover a substantial part of the latter. The discontinuous lining is preferably applied by screen printing on the textile material for forming the inner surface 31 of the parts of back 3.

The elastic textile material of serving as support for the lining 4 of silicone is advantageously very elastic and preferably has a rate of elastic extension greater than or equal to 150%, advantageously between 150% and 300%. Furthermore, the textile material selected preferably has a low density, which brings about a great capacity for allowing air to circulate through its fibers. For example, the textile support material used is constituted primarily by fibers of polyamide and of elastane.

Note that the type of lingerie item concerned by the present disclosure, the textile material of the holding element serving as support for the silicone lining 4, is not necessarily elastic and can, for example, be constituted by a flexible knit fabric without recognized elongation.

Figure 2:
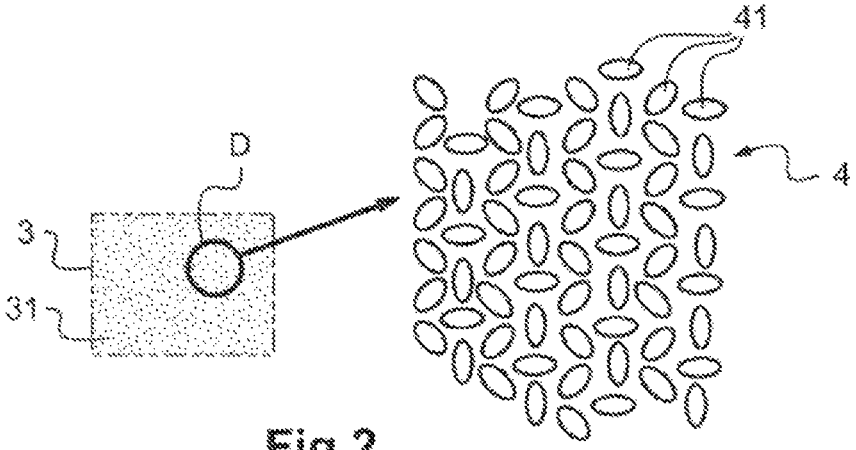
FIG. 2 is an enlarged view of encircled detail D of FIG. 1 viewed from above.

FIG. 2 shows an enlarged top view of detail D of the silicone lining 4 placed on the inner surface 31 of the parts of back 3. As shown, the lining 4 comprises a pattern of silicone points constituting protrusions 41 in the shape of a grain of rice or with a general shape that is noticeably oblong on the inner surface 31 of the parts of the back 3 of the brassiere 1. The shape of a grain of rice of the protrusion 41 is particularly adapted to optimize the surface of the skin in contact with the silicone, therefore favoring a good adherence. The silicone protrusions 41 in the shape of a grain of rice preferably have basically constant dimensions and each protrusion 41 advantageously has the following geometric characteristics:

- a length of at least 1.5, advantageously between 2 and 3 mm, with a preference for approximately 2 mm;
- a width of at least 0.5 mm, advantageously between 1 and 1.5 mm, with a preference for approximately 1 mm;
- a thickness of at least 0.3, advantageously between 0.5 and 1 mm, with a preference for approximately 1 mm.

Furthermore, a protrusion pattern with a predetermined density of protrusions 41 per surface unit in the non-stretched state of the elastic material serving as support is selected, which is less than 10 points per square centimeter, is advantageously comprised between 10 and 40 points and is preferably comprised between 25 and 36 points per square centimeter.

The silicone protrusions 41 are advantageously not connected to each other in such a manner as to not bring about shearing movements on the skin. It is also provided that the minimum or maximum distance between adjacent protrusions 41 within the protrusion pattern is preferably equal to approximately 0.5 mm or approximately 2 mm respectively.

The pattern of the protrusions 41 in the shape of grains of rice, while improving their adherence, also permits the obtention of an optimal distribution of the skin surface left free between the protrusions while avoiding occlusion points that are too close.

The shape of a grain of rice and the particular dimensions retained for the protrusions 41 as well as their distribution with a relatively high density on the inner surface 31 of the parts of the back 3 of the brassiere allows the obtention of an elevated contact surface with the skin capable of optimizing the adherence to the skin but which is nevertheless not excessive for retaining a great breathability of the part of the back of the brassiere; this is due to the fact that the exchanges between the skin and the outside can be readily carried out through the numerous spaces left free between the protrusions 41, thus avoiding irritations of the skin.

Each protrusion 41 in the shape of a grain of rice also has its own orientation within the pattern defined by the direction which the longitudinal axis of the protrusion takes considered in the reference system of the inner surface 31. According to the disclosure the distribution of the orientation of the protrusions 41 is omnidirectional in the reference system of the inner surface 31 in the sense that it should be possible to find protrusions 41 within the pattern whose respective orientations define a plurality of different directions in the plane of the inner surface 31, preferably at least 4 different directions and advantageously at least 5 different directions. In other words, the protrusions 41 have respective orientations in the plane of the inner surface 31 that alternate between a plurality of different directions considered in the plane of the inner surface, preferably between at least 4 different directions and advantageously between at least 5 different directions.

Furthermore, the distribution of relative orientation between adjacent protrusions is such that each protrusion considered within the pattern has an orientation that is noticeably different from those of the respective adjacent protrusions.

Therefore, this omnidirectional distribution of the orientation of the protrusions 41 advantageously permits the creation of a "pulling" effect on the skin which is better distributed when the brassiere is worn, which is especially favorable for preventing irritations of the skin.

It can also be observed that greater properties of adherence can be achieved due to the synergistic effect of the combination of such an omnidirectional distribution of orientation of the protrusions 41 within the pattern with the predetermined characteristics of shape, dimension and distribution of the protrusions 41.

In addition to the aspect of improving the adherence while limiting the phenomenon of occlusion and of shearing, the pattern of silicone protrusions 41 such as described advantageously furnishes a supplementary aesthetic effect, which is quite remarkable in that the protrusions constitute at the same time decorative elements whose aesthetic effect is similar to that of paste.

The invention claimed is:

1. A skin-contacting garment comprising:

at least one holding element capable of holding the skin-contacting garment when it is worn, which holding element is constituted by a textile material provided on its inner surface intended to come in contact with the skin with a discontinuous coating of elastomeric material capable of preventing the slipping of this skin-contacting garment, wherein the discontinuous coating of elastomeric material comprises a uniform pattern of protrusions of elastomeric material in the form of grains of rice having a distribution of omnidirectional orientation in a reference system of the inner surface of the holding element, where each respective protrusion comprises a longitudinal axis along a length of the respective protrusion and comprises a lateral axis along a width of the respective protrusion perpendicular to the length of the respective protrusion, the longitudinal axis defining a major axis of the respective protrusion, and the length of the protrusion being greater than the width of the protrusion, wherein the distribution of relative orientation between adjacent protrusions is such that each protrusion has an orientation of its respective longitudinal axis that is different from and nonparallel to the longitudinal axis of each directly adjacent protrusion, which protrusions comprise dimensions and a distribution such that the density of the protrusions per surface unit of the holding element is at least 10 protrusions per square centimeter.

2. The skin-contacting garment according to claim 1, wherein the density of the protrusions is between 25 and 36 protrusions per square centimeter.

3. The skin-contacting garment according to claim 1, wherein the protrusions have a length of at least 1.5 mm.

4. The skin-contacting garment of claim 3, wherein the protrusions have a length between 2 mm and 3 mm.

5. The skin-contacting garment according to claim 1, wherein the protrusions have a width of at least 0.5 mm.

6. The skin-contacting garment of claim 5, wherein the protrusions have a width between 1 mm and 1.5 mm.

7. The skin-contacting garment according to claim 1, wherein the protrusions have a thickness of at least 0.3 mm.

8. The skin-contacting garment of claim 7, wherein the protrusions have a thickness between 0.5 mm and 1 mm.

9. The skin-contacting garment according to claim 1, wherein the distance between two adjacent protrusions is between 0.5 and 2 mm.

10. The skin-contacting garment according to claim 1, wherein the elastomeric material is silicone or polyurethane.

11. The skin-contacting garment according to claim 1, wherein the skin-contacting garment is a brassiere comprising two cups connected by their respective outer side to parts of a back of the brassiere constituting the holding element of the brassiere.

12. The skin-contacting garment of claim 11, wherein the brassiere is strapless.

13. The skin-contacting garment according to claim 1, wherein the skin-contacting garment is a hosiery item terminated by an edge rib or a cord constituting the holding element of the hosiery item.

14. The skin-contacting garment of claim 1, wherein the density of the protrusions is between 10 and 40 protrusions per square centimeter.

15. The skin-contacting garment of claim 1, wherein the uniform pattern of protrusions comprises parallel rows of the protrusions.

16. The skin-contacting garment of claim 1, wherein the protrusions have respective orientations in the reference system of the inner surface that alternate between a plurality of different directions of the longitudinal axis of the protrusions.

17. The skin-contacting garment of claim 16, wherein the respective orientations of the protrusions alternate between four or five different directions of the longitudinal axis in the reference system of the inner surface.

18. A lingerie item comprising:

at least one holding element capable of holding the lingerie item when it is worn by a wearer, wherein the holding element is constituted by a textile material provided on its inner surface intended to come in contact with skin of the wearer with a discontinuous coating of elastomeric material capable of preventing the slipping of the lingerie item, wherein the discontinuous coating of elastomeric material comprises a uniform pattern of protrusions of elastomeric material, the protrusions being oblong in shape and having respective orientations in a plane defined by the inner surface of the holding element, where each respective protrusion comprises a longitudinal axis along a length of the respective protrusion and comprises a lateral axis along a width of the respective protrusion perpendicular to the length of the respective protrusion, the longitudinal axis defining a major axis of the respective protrusion, and the length of the protrusion being greater than the width of the protrusion, where the respective orientations alternate between a plurality of different directions, where the respective orientations between adjacent protrusions is such that each protrusion has an orientation of its respective longitudinal axis that is different from and nonparallel to the longitudinal axis of each directly adjacent protrusion, and where the protrusions comprise dimensions and a distribution such that the density of the protrusions per surface unit of the holding element is at least 10 protrusions per square centimeter.

19. The lingerie item of claim 18, wherein the protrusions comprise an omnidirectional orientation in the plane of the inner surface.

20. The lingerie item of claim 18, wherein the density of the protrusions is between 10 and 40 protrusions per square centimeter.

21. The lingerie item of claim 18, wherein the density of the protrusions is between 25 and 36 protrusions per square centimeter.

22. The lingerie item of claim 18, wherein the protrusions have a length between 2 and 3 mm, a width between 1 and 1.5 mm, and a thickness between 0.5 and 1 mm.

23. The lingerie item of claim 18, wherein the distance between two adjacent protrusions is between 0.5 and 2 mm.

24. The lingerie item of claim 18, wherein the elastomeric material is at least one of silicone or polyurethane.

* * * * *